US008801351B2

(12) United States Patent
Geldmeier et al.

(10) Patent No.: US 8,801,351 B2
(45) Date of Patent: Aug. 12, 2014

(54) DEVICE FOR CUTTING TO LENGTH AND FEEDING SPINE STRIPS FOR A CASE MAKER

(75) Inventors: Günter Geldmeier, Stemwede-Oppenwehe (DE); Frank Tautz, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 487 days.

(21) Appl. No.: 13/068,022

(22) Filed: Apr. 29, 2011

(65) Prior Publication Data

US 2011/0283854 A1 Nov. 24, 2011

(30) Foreign Application Priority Data

May 18, 2010 (DE) ..... 10 2010 020 878

(51) Int. Cl.
*B42C 7/00* (2006.01)

(52) U.S. Cl.
CPC ..... *B42C 7/00* (2013.01)
USPC ..... 412/3; 412/17

(58) Field of Classification Search
CPC ..... B42C 7/00
USPC ..... 412/3, 16, 17, 34, 36
See application file for complete search history.

(56) References Cited

U.S. PATENT DOCUMENTS 4,898,506 A * 2/1990 Lazar ..... 412/17
6,769,676 B2 * 8/2004 Machon et al. ..... 412/17

FOREIGN PATENT DOCUMENTS

DE 3811960 * 10/1989
DE 44 22 583 A1 1/1995
DE 100 57 599 A1 5/2002
DE 10 2006 027 903 A1 12/2007

OTHER PUBLICATIONS

German Search Report, 10 2010 020 878.7, Dated Mar. 8, 2012.

* cited by examiner

*Primary Examiner* — Kyle Grabowski
(74) *Attorney, Agent, or Firm* — Alix, Yale & Ristas, LLP

(57) ABSTRACT

In a device for cutting to length and feeding spine strips (3) for a case maker (1), a center strip conveying device (30) is provided that advances the spine strip material (5, 6) by the spine width ($B_S$) transverse to the board feed direction (23) in a cyclic fashion. The spine width ($B_S$) can be changed from work cycle to work cycle without accumulating additional waste. This can be realized because the previously required width sizing on the material web is eliminated.

18 Claims, 3 Drawing Sheets

DEVICE FOR CUTTING TO LENGTH AND FEEDING SPINE STRIPS FOR A CASE MAKER

BACKGROUND

The present invention pertains to a device for cutting to length and feeding strips for a book case maker.

In a case maker that operates in accordance with the horizontal processing principle [Liebau, Heinze; "Industrielle Buchbinderei;" Beruf and Schule Publishing, 1997; p. 399 ff.], cover boards and a spine strip of pasteboard or cardboard are joined with the blanks to be covered that are provided with glue in a roll-down device, in an accurately registered fashion. A case maker of this type is also illustrated and described in DE 100 57 599 A1. The cover boards are removed from a board magazine and fed to the roll-down device after they are laterally aligned on guide rails together with the spine strip. The spine strip used may consist of a flexible center strip roll that is cut to the appropriate length and width in the machine or a pre-cut board strip that is introduced into the feed plane of the cover boards immediately before the roll-down process. The blank to be covered is moved into the roll-down plane by means of a blank cylinder synchronous to the board feed. The protruding edges of the book case are subsequently turned in successively arranged work stations, either in a throughfeed mode or a while the respective book case is at a standstill, wherein the edges protruding on the head and the foot are usually turned in first and the edges on the sides are then turned in after turning in the corners. The book cases are ultimately guided between pressing rollers of a rub-down device in order to rub the board pieces down onto the blank to be covered. In a delivery section, the finished book cases are transported to a manual removal station in the form of stacks by means of a roller conveyor.

In known case makers of this type, the flexible center strip roll is unwound from a supply roll adjacent to the board feed and cut to width by means of rotary knives. The center strip reaches a center strip conveying device arranged between the board magazine and the roll-down device after several deflections with a dancer roll, wherein the center strip conveying device features a pull-off roller system for advancing the material web by a length equal to the spine height in a cyclic fashion. A section is cut to length by means of a cutter and introduced into the board feed plane in the form of a spine strip with other means.

During a format change, the width sizing of the center strip web is manually adjusted to another spine width, wherein it is also possible, if applicable, to change to another center strip roll in order to reduce the waste. The center strip roll that was already cut to width can no longer be used and needs to be disposed of after advancing the material web by several meters until the new width arrives on the center strip conveying device. Although a shift of the width sizing into the vicinity of the center strip conveying device would reduce the amount of waste during a format change, it would also impair the accessibility and require a more complex solution for removing the waste from the width sizing area. It is furthermore disadvantageous that significant quantities of center strip material are already cut off during the width sizing alone such that an automation of the center strip width, in which a broad range of different center strip widths is obtained from one center strip roll, is uneconomical.

SUMMARY

The present disclosure is directed to the objective of providing a device of the above-described type that allows a low-waste automation of the format change, particularly the spine strip width.

A center strip conveying device that advances the spine strip material by the spine width transverse to the board feed direction in a cyclic fashion makes it possible to change the spine width between two spine strips that were successively cut to length without accumulating additional waste. The spine strip material is no longer fed to the spine of the book case longitudinally as before, but rather transverse thereto. The separation of a section results in the desired spine width. The previously required width sizing of the material strip is eliminated. The advance of the spine strip material, for example, by means of a pair of pull-off rollers can be electronically reset from work cycle to work cycle without requiring any set-up or resetting time such that book cases with spines of different widths can be manufactured in an uninterrupted fashion.

If the guide channel for the spine strip is extended through the board magazine and extends beyond the board magazine, the center strip conveying device can be arranged on the freely protruding upstream end of the guide channel, wherein this provides the advantages of adequate access on all sides and of a simple removal of any waste that might accumulate near the guide channel. The separated spine strip can be introduced at such a location of the aforementioned guide channel that the spine strip is moved into a position between the cover boards of the board magazine with of one or more additional feed strokes of the board feed, wherein the spine strip is then additionally transported together with the cover boards separated from the magazine with the next feed stroke.

The spine strip preferably is directly inserted into the guide channel by the center strip conveying device and entirely transferred in the guide channel after the separation such that no additional conveying and guiding means are required for moving the separated spine strip into the guide channel.

The spine strips cut to the spine width can be trimmed to the spine height on at least one side by means of another cutter that is arranged downstream of the cutter for separating the sections. The spine height can be realized by changing the position of the cutter relative to the cut-to-length spine strip in the board feed direction.

In one preferred additional development, a feeder for spine strip material in the form of sheets is assigned to the center strip conveying device. The sheets may consist of flexible pasteboard (like the center strip roll) or of rigid cardboard. Special materials such as, e.g., sheet metals, plastics or special material compositions may also be considered. Numerous spine strips can be cut out of one sheet such that a new sheet is not required until a number of work cycles have been carried out. The sheets can be very easily changed during a format change, wherein a partially used sheet being removed can be used up in a follow-up order. If the supplied sheets already have a width that corresponds to the desired spine height, it is not necessary to cut the spine strips separated from the sheet to the spine height in the case maker. The available quantity of spine strips can be significantly increased with a stack magazine. Due to the separation of the respective bottom sheet, additional sheets can be put on without a machine stop.

In another preferred additional development, an unwinder for a web of spine strip material to be unwound from a supply roll is assigned to the center strip conveying device in order to process flexible center strip rolls. In addition to processing sheets, the invention is also suitable for processing webs, wherein the material web is supplied transverse to the spine and a single roll may contain a very large supply of spine strip material such that no roll changing device is required.

A cutter for trimming the spine strip material to a width that is equal to the spine height is preferably arranged upstream of the center strip conveying device such that different spine heights can be produced of the unwound web or the supplied sheet.

An arrangement of at least two center strip conveying devices makes it possible to provide several spine strip materials to be processed selectively or even redundantly in the case maker such that set-up or exchange times during an order change or roll change are eliminated.

Unneeded spine strips or spine strips with an incorrect width can be sorted out in a cyclic fashion by means of a buffer station arranged in the region of the guide channel such that the case maker does not have to be stopped for this purpose. This makes it possible, for example, to automatically remove remnants of the spine strip material that accumulate in sheet processing.

DETAILED DESCRIPTION

Figure 1:
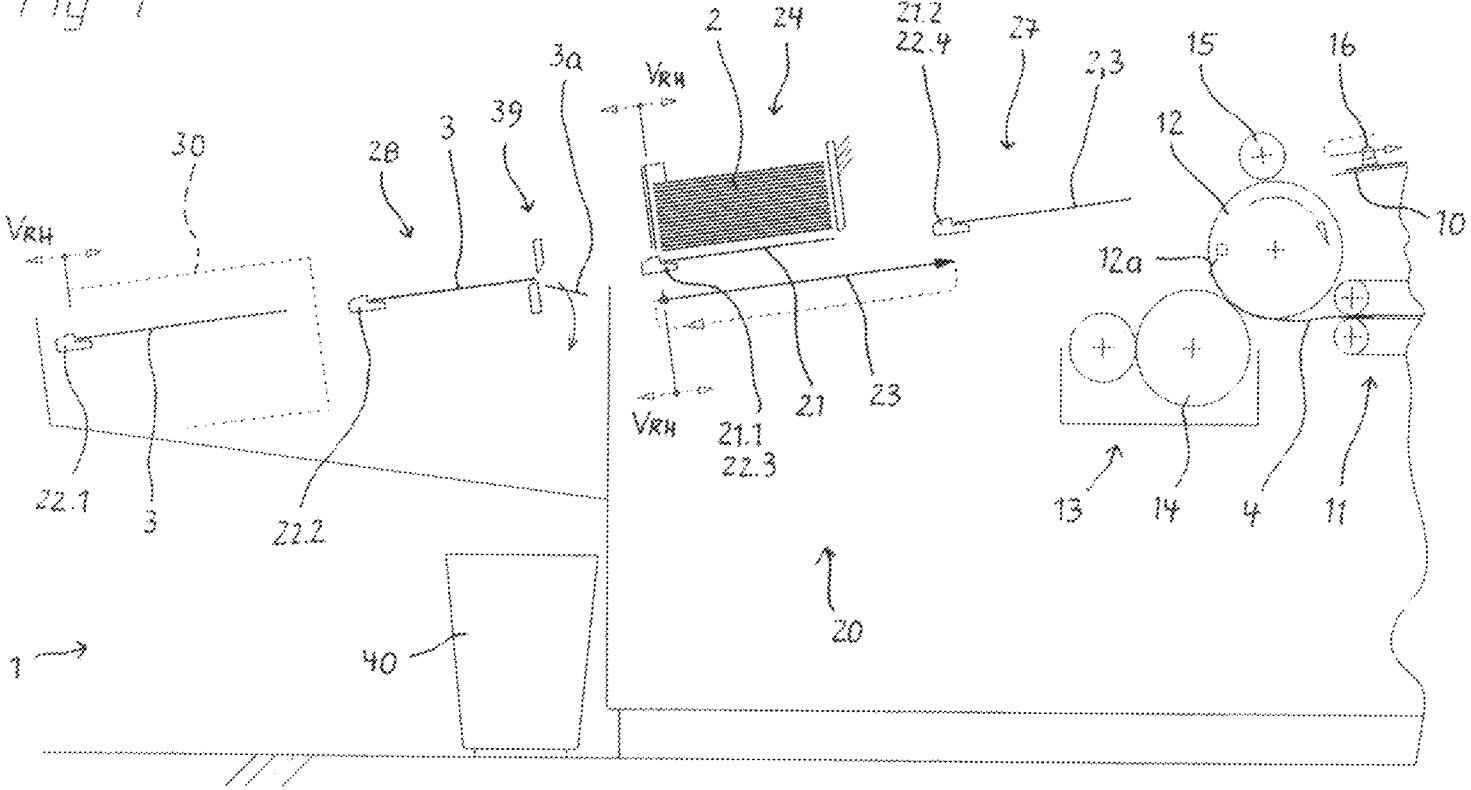
FIG. 1 shows a schematic side view of a case maker.

FIG. 1 shows a section of a case maker 1, in which book cases 10 are manufactured by joining cover boards 2 and spine strips 3 on blanks to be covered 4. One respective blank to be covered 4 is fed to a blank cylinder 12 by a not-shown conventional blank feed 11, wherein said blank cylinder takes hold of the blank to be covered 4 with grippers 12*a*, guides it past an application roller 14 of a gluing station 13 and subsequently rolls it down on the two synchronously supplied, laterally spaced cover boards 2 and the one spine board strip 3 between the cover boards in the joining point. Pressing rollers 15 press the boards 2, 3 against the blank to be covered 4 in the joining point while a suction bar 16 that carries out a reciprocating motion receives the book case 10 from the roll-down device consisting of the blank cylinder 12 and the pressing rollers 15 in order to feed the book case to a turn-in and rub-down station.

The cover boards 2 are situated in a board magazine 24. The respective bottom cover boards 2.1 are pushed out by a first board pusher 21.1 of a board feed 20 and guided into an intermediate position 27, from where they are fed to the joining point by a second board pusher 21.2 while they are aligned on outer board guides 25. The board pushers 21.1, 21.2 are coupled to one another at a fixed distance and carry out a cyclic reciprocating motion with a constant feed stroke 23 in the machine work cycle direction that is identical to this distance. In the exemplary embodiment, the leading edge of the boards 2, 3 is defined as fixed reference edge. Consequently, format adjustments $V_{RH}$ in accordance with the spine height of the book cases 10 are effective on the rear edge such that the stroke position of the feed stroke 23 is also adjusted in this respect.

The spine strips 3 are advanced in a guide channel 26 that can be adjusted to the spine strip width $B_S$ by center strip pushers 22.1 to 22.4 that are coupled to the board pushers 21.1, 21.2, wherein the spine strips 3 are introduced into the guide channel 26 that is extended through the board magazine 24 behind the board magazine 24.

Spine strip material 5, 6 is inserted into the guide channel 26 transverse to the board feed direction 23 by a pair of pull-off rollers 31 of a center strip conveying device 30, wherein sections with a spine strip width $B_S$ are separated from the spine strip material 5, 6 by means of a cutter 32 that consists of upper and lower knives 33, 34 and entirely transferred into the guide channel 26 during this process. The cut strip has leading and trailing ends and first center strip pusher 22.1 acts on the trailing end to move the separated spine strip 3 into an intermediate position 28 and the second center strip pusher 22.2 subsequently transports the spine strip from this intermediate position into a position within the board magazine 24, from where it is then additionally transported to the roll-down device together with the cover boards 2 by means of the third and the fourth center strip pusher 22.3 and 22.4.

Figure 3:
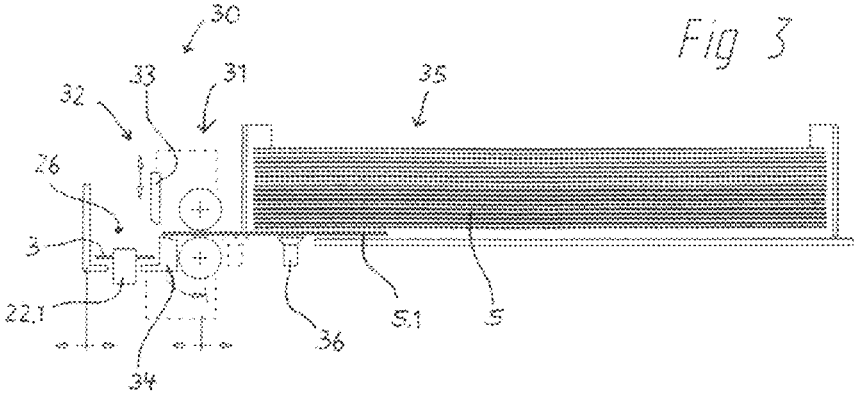
FIG. 3 shows a transverse view of a center strip conveying device with assigned sheet magazine.

FIG. 3 shows a first embodiment of the center strip feed. A source of spine strip material includes a sheet magazine 35 for spine strip sheets 5, assigned to the center strip conveying device 30, wherein the respective bottom spine strip sheet 5.1 is respectively separated from this sheet magazine by means of a suction apparatus 36 and fed to the pair of pull-off rollers 31 in order to be advanced by the spine strip width $B_S$ in a cyclic fashion.

Figure 2:
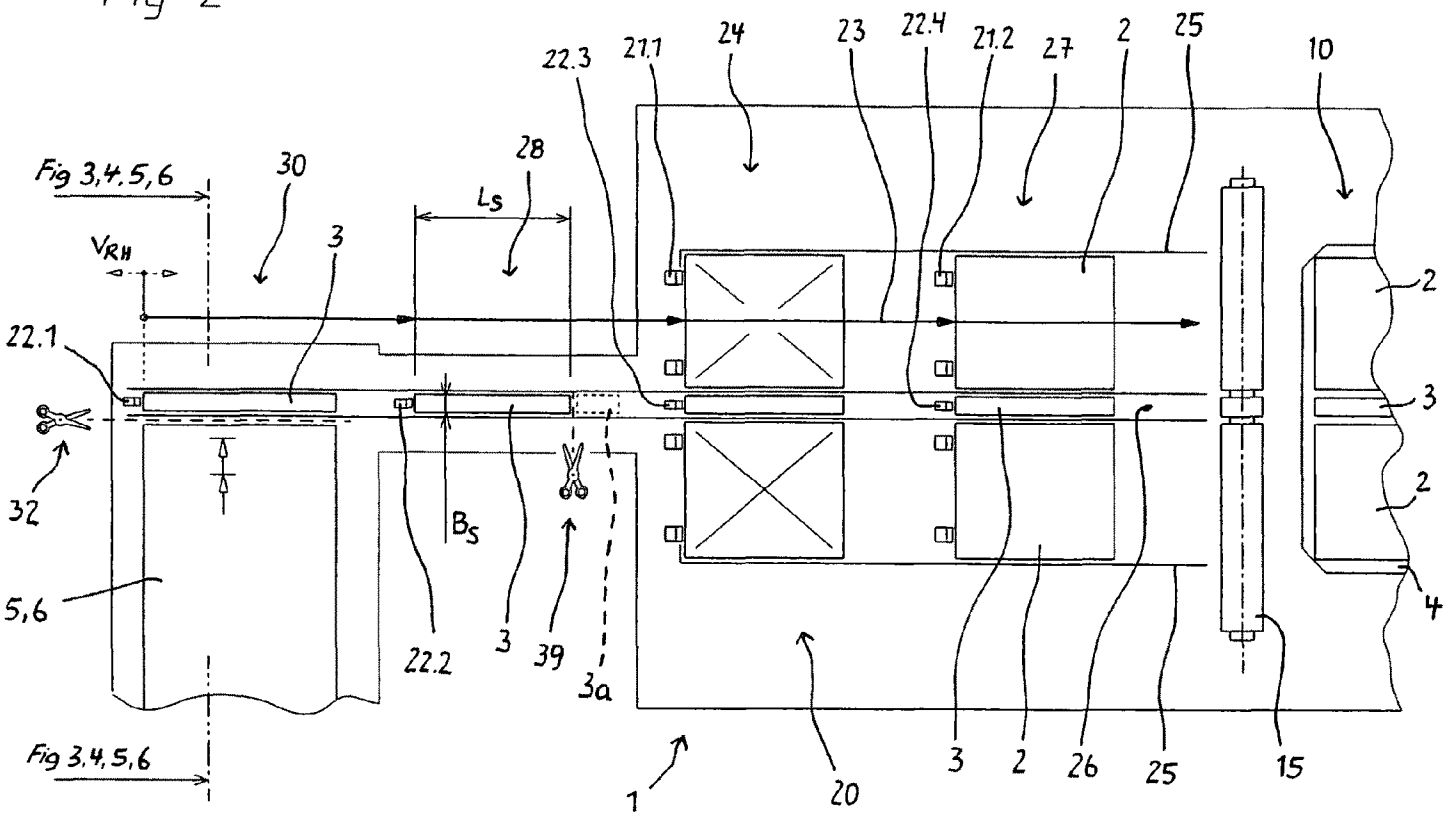
FIG. 2 shows a top view of the case maker.

The spine strip sheets 5 may already be pre-cut to a width that corresponds to the required spine strip length $L_S$ by means of rotary board cutters or guillotine cutters. In this case, it is no longer necessary to cut the spine strips 3 separated from the spine strip sheets 5 to the required spine strip length $L_S$ in the case maker 1. In FIGS. 1 and 2, the spine strip 3 separated from the spine strip material 5, 6 is slightly longer than the required spine strip length $L_S$. The spine strip length is realized by trimming the spine strip on one side by means of a cutter 39 arranged on the guide channel 26 in the intermediate position 28. The separated waste section 3 a can simply drop into a waste bin 40 provided for this purpose.

The spine strip sheets 5 may consist of flexible pasteboard (like the center strip rolls) or of rigid cardboard. It would also be possible to supply other materials such as, e.g., sheet metals, plastics or special material compositions with the center strip feed according to FIG. 3.

Figure 4:
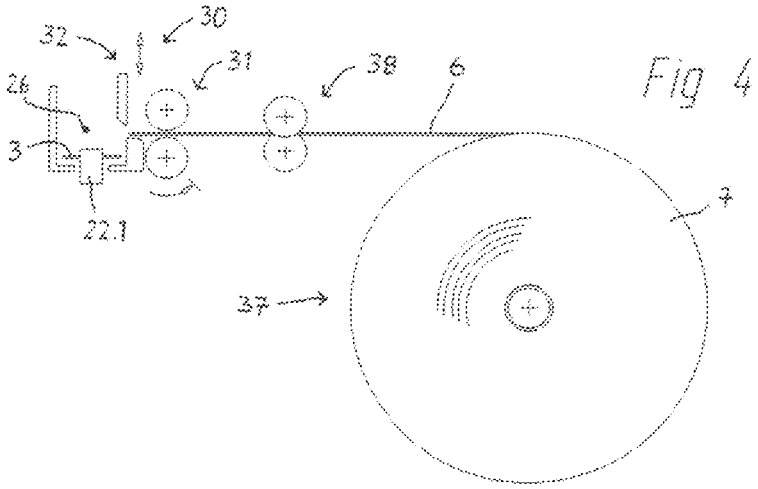
FIG. 4 shows a transverse view of a center strip conveying device for processing center strip rolls.

FIG. 4 shows a second embodiment of the center strip feed. In this case, an unwinder 37 for a spine strip web 6 to be unwound from a supply roll 7 is assigned to the center strip conveying device 30 in order to process flexible center strip rolls. In addition, a lateral trimmer 38 is provided in order to cut the spine strip web 6 to a width that corresponds to the required spine strip length $L_S$. The lateral trimmer 38 could also be used in the sheet processing according to FIG. 3. This makes it possible to produce different spine strip lengths $L_S$ of the unwound spine strip web 6 or the supplied spine strip sheets 5, respectively.

Since the spine strip web 6 is supplied transverse to the spine and the spine strips 3 are separated with a narrow spine strip width $B_S$, a single roll contains a very large supply of spine strip material such that no roll changing device is required.

Figure 5:
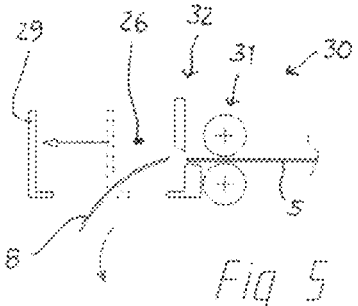
FIG. 5 shows the center strip conveying device with assigned buffer station.

FIG. 5 shows a buffer station for unneeded spine strips or spine strips with an incorrect width such as, e.g., remnants 8 of the supplied spine strip sheets 5 that accumulate in sheet processing. These spine strips are automatically sorted out by simply opening and closing a guide rail 29 that bounds the guide channel 26.

Figure 6:
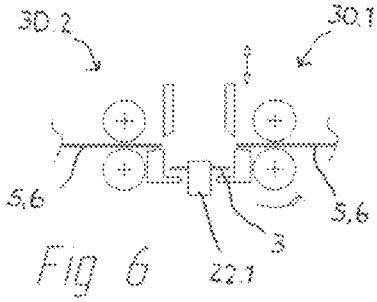
FIG. 6 shows two center strip conveying devices for selectively supplying spine strip material.

FIG. 6 shows an arrangement of two center strip conveying devices 30.1, 30.2 for selectively supplying spine strip material 5, 6. The two center strip conveying devices 30.1, 30.2 may respectively supply spine strip sheets 5 or spine strip webs 6 of the same quality and dimensions in the sense of a redundant arrangement such that the second center strip conveying device 30.2 can continue to supply spine strip material in case the first center strip conveying device 30.1 malfunctions or its spine strip material 5, 6 is depleted. However, the second center strip conveying device 30.2 may also be prepared with another spine strip material 5, 6 intended for a follow-on order such that the set-up or exchange times on the center strip feed are eliminated during an order change.

The invention claimed is:

1. In a book case making machine (1) comprising a source of spine center strip material, a center strip conveying device (30), a cutter (32) for separating a spine strip (3) from spine strip source material, and means for introducing the spine strip (3) of width (Bs) into a guide channel (26) of a board feed (20) that advances the spine strip (3) between spaced apart cover boards (2) in a feeding direction (23) synchronously with (2, 3) the delivery and joining of a blank to the two boards and center strip, which blank (4) is provided with glue on a glue application roller (14) and supplied by a blank cylinder (12) in a roll-down device (12, 15), wherein the improvement comprises that the center strip conveying device (30) advances (31) the spine strip material (5, 6) to the cutter (32) by the spine width ($B_S$) transverse to the board feed direction (23) in a cyclic fashion.

2. The machine according to claim 1, wherein the center strip conveying device (30) is arranged behind a board magazine (24) for the cover boards (2) and features a guide channel (26) for receiving the separated spine strips (3), which guide channel extends through the board magazine (24).

3. The machine according to claim 2, wherein the spine strip (3) is inserted into the guide channel (26) by the center strip conveying device (30), and the spine strip (3) is entirely transferred into the guide channel (26) after the separation.

4. The machine according to claim 2, wherein the cut spine strip has leading and trailing ends and the device includes another cutter (39) for trimming at least one of the leading or trailing ends of the spine strip (3) to a spine height ($L_S$) of the book case, after the strip (3) has cut to the spine width ($B_S$).

5. The machine according to claim 1, wherein the spine strip (3) is inserted into the guide channel (26) by the center strip conveying device (30), and the spine strip (3) is entirely transferred into the guide channel (26) after the separation.

6. The machine according to claim 1, wherein the source includes a feeder (35, 36) that feeds sheets (5) of spine strip source material to the strip conveying device (30) for advancement (31) to the cutter (32) transversely to the board feed direction (23).

7. The machine according to claim 6, wherein the sheets (5) have a width that corresponds to the spine height ($L_S$).

8. The machine according to claim 6, including a magazine (35) for stacks of said sheets (5) that features a separating device (36) for transferring successive bottom sheets of the stack (5.1) for advancement (31) to the cutter (32) transversely to the board feed direction (23).

9. The machine according to claim 1, including an unwinder (37) for a web (6) of spine strip source material to be unwound from a supply roll (7), wherein said unwinder delivers web material (30) to the strip conveying device (30) for advancement (31) to the cutter (32) transversely to the board feed direction (23).

10. The machine according to claim 1, wherein the book case has a spine height ($L_S$) and the machine includes another cutter (38) that is arranged upstream of the center strip conveying device (30) for trimming the spine strip material (5, 6) to length corresponding to the spine height ($L_S$).

11. The machine according to claim 1, including an arrangement of at least two center strip conveying devices (30.1, 30.2) for selectively advancing a respective spine strip material (5, 6).

12. The machine according to claim 1, including a buffer station (29) for receiving unneeded cut spine strips.

13. A machine for manufacturing book cases (10) in which for each book case two laterally spaced apart cover boards (2) and a spine strip board (3) having a width (Bs) centered in the space between the cover boards (3) are advanced in a machine work cycle direction (23) until adhesively joined (12, 15) to a blank (4), comprising:

a spine strip cutting station;

a source of spine strip material;

a guide channel (26) extending in the work cycle direction from the spine strip cutting station through the space between the spaced apart cover boards;

a first transporter (31) for cyclically advancing a leading portion of spine strip material (5, 6) from the source into the guide channel (26) in a direction transverse to the guide channel;

a cutter (32) acting on the portion of spine strip material that is advanced into the guide channel (26), to separate a spine strip (3) with the spine width ($B_S$) from the portion of spine strip material; and a second transporter (22.1) for advancing the separated spine strip through the guide channel in the work cycle direction toward the space between the cover boards.

14. The machine according to claim 13, wherein the machine includes a magazine (24) for the cover boards (2) and the guide channel (26) extends in the work cycle direction through the board magazine (24).

15. The machine according to claim 13, wherein the cutter (32) includes at least one knife (33, 34) that cuts the spine strip material (5, 6) while the spine strip material is in the guide channel (26).

16. The machine according to claim 15, wherein the cut spine strip falls entirely into the guide channel (26) with leading and trailing ends, and the second transporter includes a pusher (22.1) that acts on the trailing end to advance the spine strip through the guide channel.

17. The machine according to claim 16, wherein the machine includes a magazine (24) for the cover boards (2), the guide channel (26) extends in the work cycle direction through the board magazine (24), and the pusher (22.1) advances the spine strip to an intermediate position along the work cycle direction, where another pusher (22.2) transports the spine strip thorough the guide channel toward the board magazine.

18. In a book case making machine (1) comprising a source of spine material, a center strip conveying device (30), a cutter (32) for separating a spine strip (3) from spine strip source material, and means for introducing the spine strip (3) of width (Bs) into a guide channel (26) of a board feed (20) that advances the spine strip (3) and other cover boards (2) in a feeding direction (23) synchronously with (2, 3) the delivery and joining of a blank to be covered (4) that is provided with glue on a glue application roller (14) and supplied by a blank cylinder (12) in a roll-down device (12, 15), wherein the improvement comprises that the center strip conveying device (30) advances (31) the spine strip material (5, 6) by the spine width ($B_S$) transverse to the board feed direction (23) in a cyclic fashion, the cut spine strip (3) has leading and trailing ends, and the device includes another cutter (39) for trimming at least one of the leading or trailing ends of the spine strip (3)

to a spine height ($L_S$) of the book case, after the strip (3) has been cut to the spine width ($B_S$).

* * * * *